US008573132B2

(12) United States Patent
Conte et al.

(10) Patent No.: US 8,573,132 B2
(45) Date of Patent: Nov. 5, 2013

(54) CABLE TRANSPORTATION SYSTEM SWITCH AND CABLE TRANSPORTATION SYSTEM COMPRISING SUCH A SWITCH

(75) Inventors: Giuseppe Conte, Bolzano (IT); Franco Coco, Laives (IT)

(73) Assignee: Rolic International S.AR.L., Luxembourg (LU)

( * ) Notice: Subject to any disclaimer, the term of this patent is extended or adjusted under 35 U.S.C. 154(b) by 137 days.

(21) Appl. No.: 13/182,977

(22) Filed: Jul. 14, 2011

(65) Prior Publication Data

US 2012/0090496 A1 Apr. 19, 2012

(30) Foreign Application Priority Data

Jul. 14, 2010 (IT) ..... MI2010A1297

(51) Int. Cl.
*E01B 25/15* (2006.01)

(52) U.S. Cl.
USPC ..... 104/130.01

(58) Field of Classification Search
USPC ..... 104/130.01, 103, 184, 189, 188; 246/388, 385
See application file for complete search history.

(56) References Cited

U.S. PATENT DOCUMENTS

| | | | | |
|---|---|---|---|---|
| 472,211 | A | 4/1892 | Fralinger | |
| 926,058 | A * | 6/1909 | Fouts | 104/184 |
| 972,997 | A * | 10/1910 | Carr | 104/130.01 |
| 1,944,446 | A | 1/1934 | McGowen | |
| 2,662,587 | A | 12/1953 | McIlvaine | |
| 2,710,650 | A | 6/1955 | Sowder | |
| 2,985,224 | A | 5/1961 | Sowder | |
| 3,170,412 | A | 2/1965 | Sowder | |
| 3,540,380 | A * | 11/1970 | Tumpak et al. | 104/246 |
| 3,934,517 | A | 1/1976 | Hirsig | |
| 4,185,562 | A | 1/1980 | Hatori et al. | |
| 4,226,187 | A | 10/1980 | Paulsen et al. | |
| 4,269,123 | A | 5/1981 | Segafredo | |
| 4,280,411 | A | 7/1981 | Katayose et al. | |
| 4,462,314 | A | 7/1984 | Kunczynski | |
| 4,470,355 | A | 9/1984 | Kunczynski | |
| 4,473,011 | A | 9/1984 | Wuschek | |
| 4,640,197 | A | 2/1987 | Brian | |
| 4,641,587 | A | 2/1987 | Dalliard | |
| 4,671,187 | A | 6/1987 | Kunczynski | |

(Continued)

FOREIGN PATENT DOCUMENTS

| | | |
|---|---|---|
| AT | 315910 | 6/1974 |
| AT | 342655 | 4/1978 |

(Continued)

OTHER PUBLICATIONS

Search Report for Italian MI20101297 dated Mar. 1, 2011.

*Primary Examiner* — Mark Le
(74) *Attorney, Agent, or Firm* — Neal, Gerber & Eisenberg LLP

(57) ABSTRACT

A cable transportation system switch having a first straight rail; a second straight rail forming an angle of more than 0° and less than 45° with the first straight rail; and a third straight rail located between the first and second straight rail and movable selectively between a first operating position, in which the third straight rail contacts the first straight rail and is parallel to the second straight rail, and a second operating position, in which the third straight rail contacts the second straight rail and is parallel to the first straight rail.

20 Claims, 3 Drawing Sheets

(56) References Cited

U.S. PATENT DOCUMENTS

| | | | |
|---|---|---|---|
| 4,833,997 | A | 5/1989 | Cathiard |
| 4,898,100 | A | 2/1990 | Brochand |
| 5,107,771 | A | 4/1992 | Kainz |
| 5,113,768 | A | 5/1992 | Brown |
| 5,226,368 | A | 7/1993 | Brochand et al. |
| 5,515,789 | A | 5/1996 | Brochand et al. |
| 5,562,040 | A | 10/1996 | Egli |
| 5,582,109 | A | 12/1996 | Levi et al. |
| 5,595,122 | A | 1/1997 | Levi et al. |
| 6,036,282 | A | 3/2000 | Clarke et al. |
| 6,345,578 | B1 | 2/2002 | Pabst |
| 6,543,366 | B2 | 4/2003 | Pabst et al. |
| 6,585,232 | B2 | 7/2003 | Rechenmacher |
| 7,410,068 | B1 | 8/2008 | Andreetto |
| 7,549,377 | B2 | 6/2009 | Pabst |
| 2002/0026839 | A1 | 3/2002 | Lehtovaara |
| 2002/0088368 | A1 | 7/2002 | Pabst et al. |
| 2006/0249718 | A1 | 11/2006 | Levi |
| 2007/0169660 | A1 | 7/2007 | Pabst |
| 2008/0115689 | A1 | 5/2008 | Heil et al. |
| 2009/0165666 | A1 | 7/2009 | Pabst et al. |
| 2009/0165668 | A1 | 7/2009 | Andreetto |

FOREIGN PATENT DOCUMENTS

| | | |
|---|---|---|
| AT | 373832 | 2/1984 |
| AT | 388146 | 5/1989 |
| AT | 390926 | 7/1990 |
| AT | 404010 | 7/1998 |
| AT | 405269 | 6/1999 |
| AT | 389087 | 3/2008 |
| CH | 259291 | 1/1949 |
| CH | 360704 | 3/1962 |
| CH | 542740 | 10/1973 |
| CH | 554761 | 10/1974 |
| CH | 671929 | 10/1989 |
| DE | 423865 | 1/1926 |
| DE | 2020746 | 12/1971 |
| DE | 2101743 | 9/1972 |
| DE | 2636888 | 5/1977 |
| DE | 3109294 | 10/1982 |
| DE | 3834116 | 5/1989 |
| DE | 3927757 | 3/1991 |
| DE | 4127373 | 2/1993 |
| DE | 202007006169 | 7/2007 |
| EP | 0055955 | 7/1982 |
| EP | 0135239 | 3/1985 |
| EP | 0158095 | 10/1985 |
| EP | 0218306 | 4/1987 |
| EP | 0218897 | 4/1987 |
| EP | 0281205 | 9/1988 |
| EP | 0491632 | 6/1992 |
| EP | 0517622 | 12/1992 |
| EP | 0613807 | 9/1994 |
| EP | 0640518 | 3/1995 |
| EP | 0678433 | 10/1995 |
| EP | 0687607 | 12/1995 |
| EP | 0692418 | 1/1996 |
| EP | 0745526 | 12/1996 |
| EP | 0970864 | 1/2000 |
| EP | 1077167 | 2/2001 |
| EP | 1088729 | 4/2001 |
| EP | 1174323 | 1/2002 |
| EP | 1195305 | 4/2002 |
| EP | 1209055 | 5/2002 |
| EP | 1331151 | 7/2003 |
| EP | 1364853 | 11/2003 |
| EP | 1419950 | 5/2004 |
| FR | 891743 | 3/1944 |
| FR | 913146 | 8/1946 |
| FR | 1100001 | 9/1955 |
| FR | 1199721 | 12/1959 |
| FR | 1423648 | 1/1966 |
| FR | 2340895 | 9/1977 |
| FR | 2387830 | 11/1978 |
| FR | 2391450 | 12/1978 |
| FR | 2392858 | 12/1978 |
| FR | 2562857 | 10/1985 |
| FR | 2640247 | 6/1990 |
| FR | 2670452 | 6/1992 |
| FR | 2706404 | 12/1994 |
| FR | 2823482 | 10/2002 |
| FR | 2867142 | 9/2005 |
| GB | 1326264 | 8/1973 |
| GB | 1353030 | 5/1974 |
| GB | 1460106 | 12/1976 |
| GB | 2017024 | 9/1979 |
| WO | WO2004067347 | 8/2004 |
| WO | WO2004085221 | 10/2004 |
| WO | WO2005032901 | 4/2005 |
| WO | WO2008020021 | 2/2008 |
| WO | WO2008129017 | 10/2008 |
| WO | WO2008129019 | 10/2008 |
| WO | WO2009/000059 | 12/2008 |
| WO | WO2009019259 | 2/2009 |
| WO | WO2009053485 | 4/2009 |

* cited by examiner

CABLE TRANSPORTATION SYSTEM SWITCH AND CABLE TRANSPORTATION SYSTEM COMPRISING SUCH A SWITCH

PRIORITY CLAIM

This application claims the benefit of and priority to Italian Patent Application No. MI2010A 001297, filed on Jul. 14, 2010, the entire contents of which are incorporated by reference herein.

BACKGROUND

Certain known cable transportation systems are described in documents CH Patent No. 671,929; AT Patent No. 404,010; U.S. Pat. No. 5,582,109; EP Patent No. 687,607; AT Patent No. 405,269; EP Patent No. 1,077,167; EP Patent No. 1,088,729; IT Patent No. 1,313,914; IT Patent No. 1,317,169; IT Patent No. 1,316,131; IT Patent No. 1,326,531; WO Patent Application No. 08/129,019; WO Patent Application No. 2009/019,259; and WO Patent Application No. 2009/053,485.

The tracks of cable transportation systems of these type sometimes have forks. One particular type is that in which the track forks into two at a stop station for two transportation units traveling in opposite directions. Generally speaking, cable transportation system tracks may comprise two-way single-rail portions, and two-rail portions along which the transportation units pass one another in opposite directions.

When the transportation units travel in opposite directions along the track, the system comprises two respective hauling cables operated in opposite directions. In certain know cable transportation systems, the hauling cables extend parallel to the track, between the rails, and are connected to the transportation units by clamps integral with the units. Therefore, in addition to ensuring continuity of the track, the switches must also be configured to avoid interfering with the hauling cable/s and clamps.

One example of a known switch for cable transportation systems is described in IT Patent No. 1,326,531, in which the switch comprises a track portion defined by two parallel curved rails extending along respective arcs, mounted on a pivot, and configured to connect different branches of the track, depending on the angular position of the pivot.

The above switch has proved successful, but has the drawback of comprising a moving part of considerable size and weight. Moreover, the pivot has to travel a long way to switch the rails, which therefore takes considerable time.

SUMMARY

The present disclosure relates to a cable transportation system switch.

More specifically, in one embodiment the present disclosure relates to a switch for a cable transportation system comprising transportation units moved by at least one hauling cable along a track defined by pairs of parallel rails.

It is an object of the present disclosure to provide a cable transportation system switch that is relatively easy to produce and operate.

Another object of the present disclosure to provide a cable transportation system switch featuring a relatively small moving part.

Another object of the present disclosure to provide a cable transportation system switch that is relatively easy to move.

According to one embodiment of the present disclosure, there is provided a cable transportation system switch comprising: a first straight rail; a second straight rail forming an angle of more than 0° and less than 45° with the first straight rail; a third straight rail located between the first and second straight rail and movable selectively between a first operating position, in which the third straight rail contacts the first straight rail and is parallel to the second straight rail, and a second operating position, in which the third straight rail contacts the second straight rail and is parallel to the first straight rail.

By virtue of one embodiment of the present disclosure, switching is performed by simply moving the third straight rail, which, combined with the first straight rail, at least partly defines one branch of the track, and, combined with the second straight rail, at least partly defines a further branch of the track. This switch configuration has a relatively compact, lightweight moving part, and provides for faster switching between the first and second operating positions.

In one embodiment, the first and second straight rail have a first and second contoured portion respectively; and the third straight rail has a contoured end configured to form a joint with the first and second contoured portion.

This configuration of the first, second and third straight rail ensures the continuity of the track.

In another embodiment, the present disclosure also relates to a cable transportation system.

According to another embodiment of the present disclosure, there is provided a cable transportation system comprising: at least one transportation unit having wheels, and steering trolleys for steering the wheels; a track along which the transportation unit runs; two hauling cables engageable by the transportation unit; and a switch located along the track.

Additional features and advantages are described in, and will be apparent from, the following Detailed Description and the figures.

BRIEF DESCRIPTION OF THE DRAWINGS

A non-limiting embodiment of the present disclosure will be described by way of example with reference to the accompanying drawings, in which.

DETAILED DESCRIPTION

Figure 1:
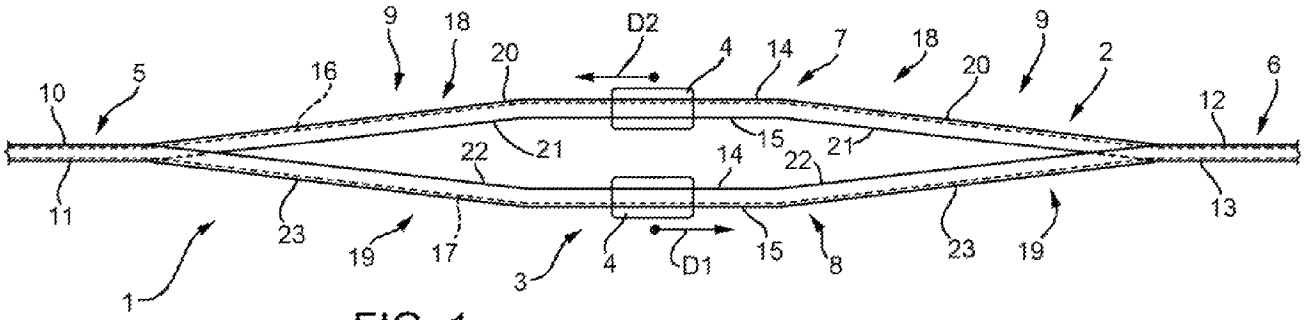
FIG. 1 shows a schematic plan view, with parts removed for clarity, of a cable transportation system in accordance with one embodiment of the present disclosure.

Referring now to the example embodiments of the present disclosure illustrated in FIGS. 1 to 4, number 1 in FIG. 1 indicates as a whole a rail-mounted cable transportation system.

Cable transportation system 1 comprises a track 2; a stop station 3 along track 2; and two transportation units 4. Track 2 is defined by parallel rails with a gauge S (FIG. 2), and comprises two series branches 5 and 6, and two parallel branches 7 and 8 connected to branches 5 and 6 by two switches 9.

Branch 5 comprises two parallel rails 10 and 11; branch 6 comprises two parallel rails 12 and 13; and branches 7 and 8 each comprise two parallel rails 14 and 15.

Cable transportation system 1 comprises two hauling cables 16 and 17 extending along track 2, between the rails, and operated in opposite directions D2 and D1 respectively.

More specifically, both hauling cables 16 and 17 extend along branches 5 and 6, whereas only hauling cable 16 extends along branch 7, and only hauling cable 17 extends along branch 8.

Figure 2:
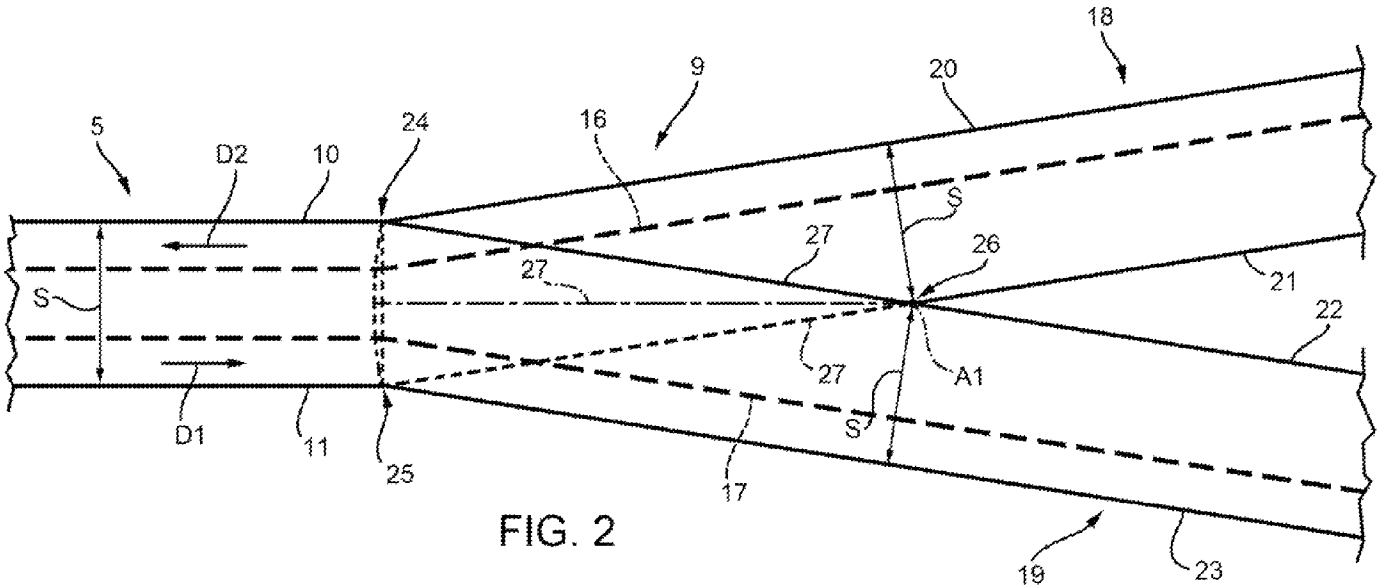
FIG. 2 shows a larger-scale, schematic plan view, with parts removed for clarity, of a switch of the FIG. 1 cable transportation system.

With reference to FIG. 2, each switch 9 comprises two diverging branches (or converging branches, depending on the travelling direction) 18 and 19 for connecting branch 5 (or branch 6) to branches 7 and 8 (FIG. 1). Branches 18 and 19 form a 12° angle, though the present disclosure also applies to switches with branches 18 and 19 forming angles of 0° to 45°.

Branch 18 comprises two straight parallel rails 20 and 21, and branch 19 comprises two straight parallel rails 22 and 23.

Straight rail 20 is connected to rail 10 at a connecting point 24; straight rail 23 is connected to rail 11 at a connecting point 25; whereas straight rails 21 and 22 converge and contact one another at a vertex 26.

Switch 9 comprises a movable straight rail 27 mounted for rotation at vertex 26, and movable selectively into a first operating position shown by the continuous line in FIG. 2, and a second operating position shown by the dash line in FIG. 2. The dot-and-dash line shows straight rail 27 in an intermediate position between the first and second operating position. In the first operating position, straight rail 27 is parallel to straight rail 23, aligned with straight rail 22, connected to rail 10, and contacting straight rail 20. In the second operating position, straight rail 27 is parallel to straight rail 20, aligned with straight rail 21, connected to rail 11, and contacting straight rail 23.

Straight rail 27 rotates about an axis A1, which is perpendicular to the plane of straight rails 20, 23, 27, is located close to vertex 26, and is the same distance, substantially equal to gauge S of track 2, from rails 20 and 23.

Figure 3:
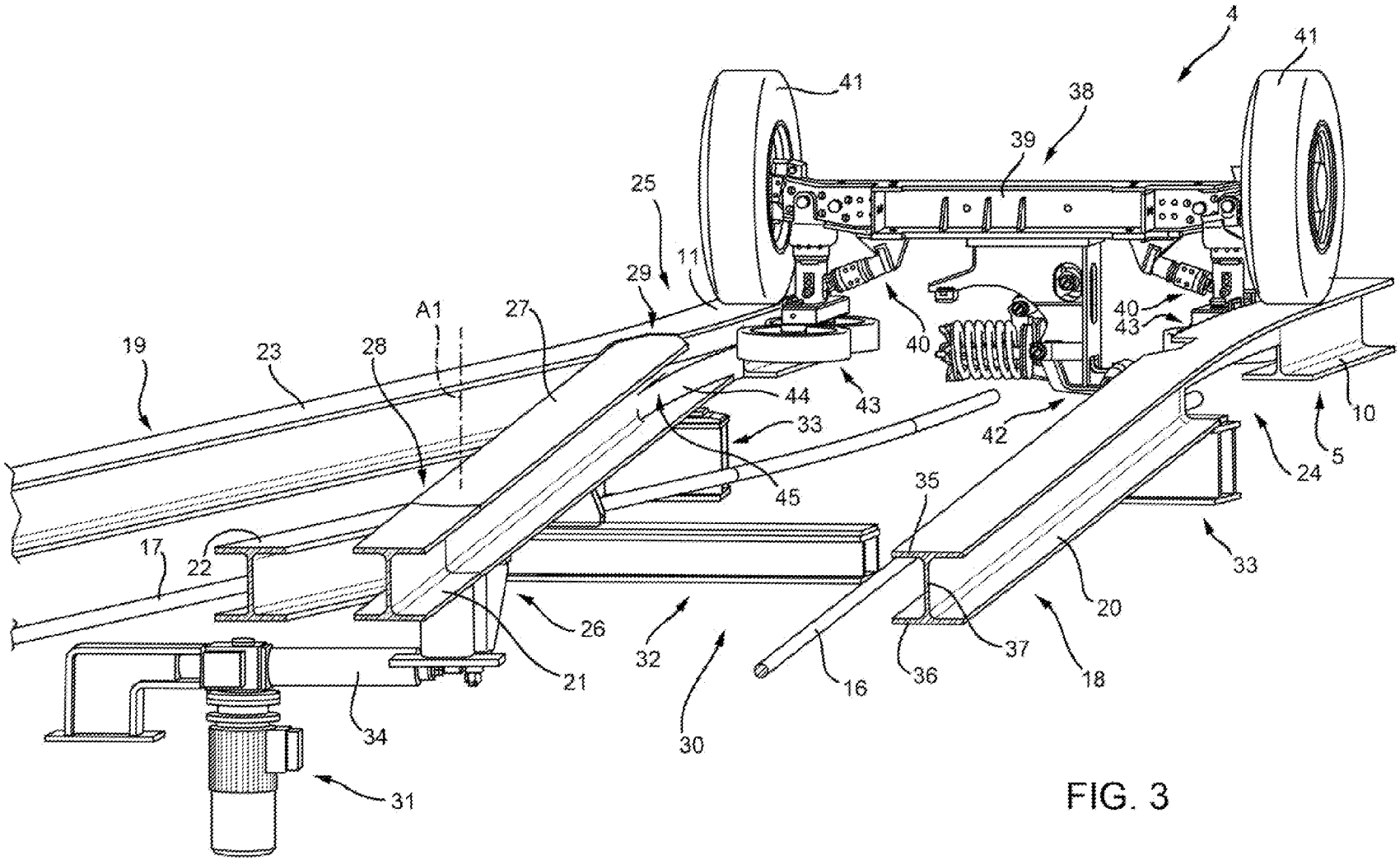
FIG. 3 shows a larger-scale view in perspective, with parts removed for clarity, of a switch in accordance with one embodiment of the present disclosure.
Figure 4:
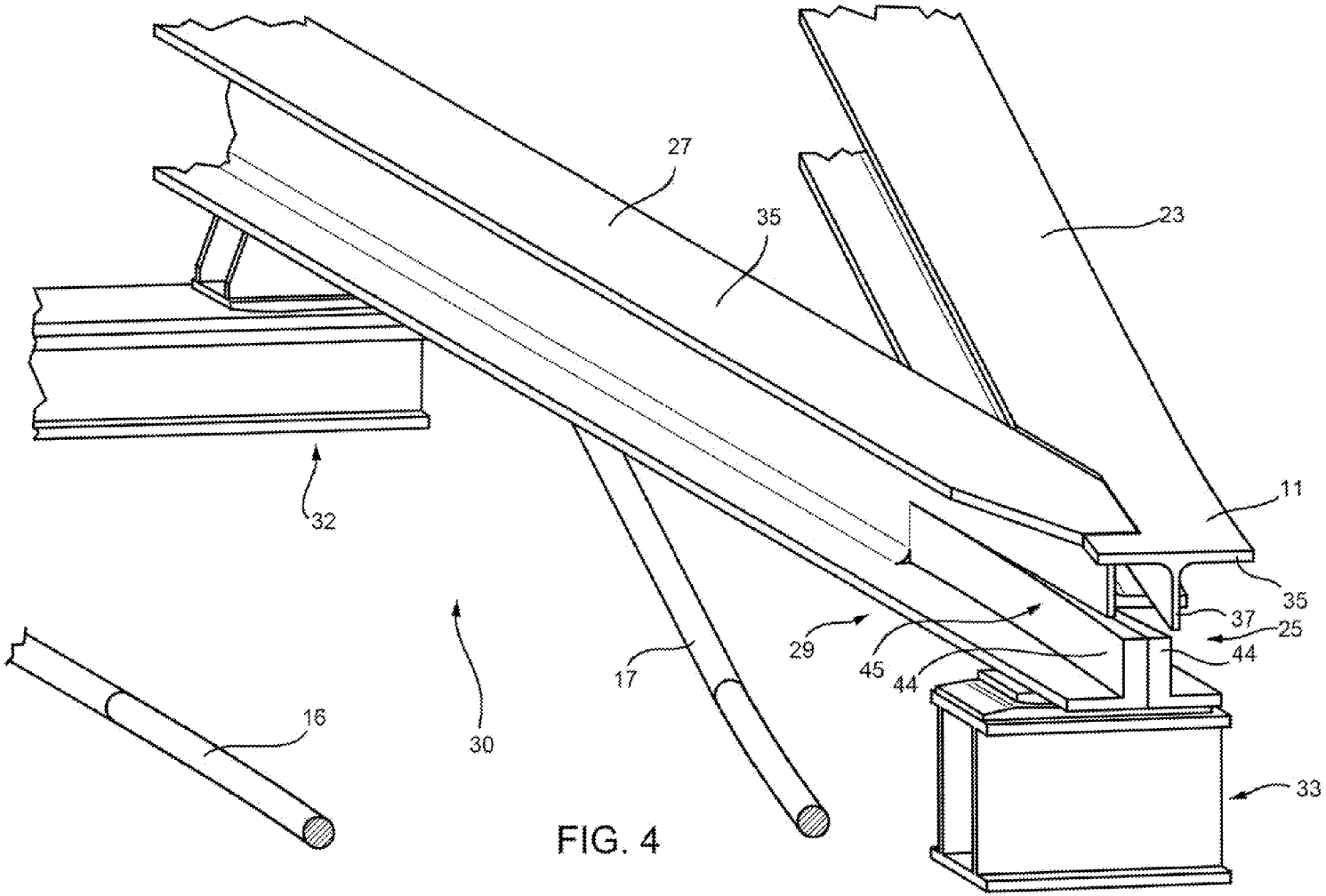
FIG. 4 shows a larger-scale view in perspective, with parts removed for clarity, of a detail of the FIG. 3 switch.

With reference to FIG. 3, straight rail 27 has a hinged end 28 adjacent to straight rails 21, 22 at vertex 26 and in the shape of an arc centered about axis Al; and a free end 29 configured to form a joint with straight rails 20 and 23 at respective connecting points 24 and 25, which are spaced apart by a distance substantially equal to the gauge S of track 2. The free end 29 of straight rail 27 thus moves along an arc, which is centered about axis A1, is defined at the ends by connecting points 24 and 25, and has a chord substantially equal in length to gauge S.

Each switch 9 comprises a supporting structure 30 for supporting straight rail 27; and an actuating device 31 for operating straight rail 27. Supporting structure 30 comprises a guide 32 located beneath and for guiding straight rail 27 between the first and second operating positions; and two supporting members 33 beneath respective connecting points 24 and 25.

Actuating device 31 comprises a linear actuator 34 connected to supporting structure 30 and to straight rail 27, between ends 28 and 29.

As an alternative to the linear actuator, actuating device comprises a rotating actuator connected to the rail by means of a crank having one end engaged in a slit made in the rail.

Each of rails 10, 11, 12, 13, 14, 15, 20, 21, 22, 23, 27 (FIG. 1) is defined by a beam—in the example shown, an HEB beam—comprising an upper flange 35 and a lower flange 36 parallel to each other and connected by a web 37.

In actual use, upper flange 35 and web 37 define respective rolling tracks for transportation units 4, as shown more clearly in FIG. 3.

Number 38 in FIG. 3 indicates an axle forming part of a transportation unit 4, and which comprises a frame 39; two steering assemblies 40 connected to frame 39; two wheels 41 connected to respective steering assemblies 40; and a clamp 42 for selectively gripping and releasing hauling cable 16. Each steering assembly 40 comprises a steering trolley 43 configured to roll along the track defined by web 37, and to steer a respective wheel 41.

Rail 10 and straight rail 20 have contoured portions at connecting point 24 for forming a joint with the free end 29 of straight rail 27; rail 11 and straight rail 23 have contoured portions at connecting point 25 for also forming a joint with the free end 29 of straight rail 27; and the free end 29 of straight rail 27 is shaped to form the joints with the respective contoured portions at connecting points 24 and 25, and to connect the rolling tracks.

More specifically, the bottom parts of rail 10 and straight rail 20 are removed or define cutouts along the contoured portions at connecting point 24, and the bottom parts of rail 11 and straight rail 23 are removed or define cutouts along the contoured portions at connecting point 25. More specifically, lower flange 36 is removed completely, and roughly half the height of web 37 is removed. Conversely, the top part of straight rail 27 is removed or defines a cutout at free end 29. That is, upper flange 35 is removed completely, and roughly half the height of web 37 is removed at free end 29.

The free end 29 of straight rail 27 is also configured to form a curved path at both connecting points 24 and 25.

More specifically, straight rail 27 comprises two connecting members 44 located symmetrically on opposite sides of web 37 at free end 29. One connecting member 44 comprises a curved face 45 tangent to web 37 of straight rail 27 and to web 37 of rail 10 at connecting point 24; and the other connecting member 44 comprises a curved face 45 tangent to web 37 of straight rail 27 and to web 37 of rail 11 at connecting point 25.

The switch according to the present disclosure has numerous advantages. In particular, the moving part of the switch is relatively compact and lightweight, and only has to move a relatively short distance, so the movable straight rail can be moved quickly between the first and second operating position. Moreover, the configuration of the free end of the movable straight rail forms smooth rolling tracks for the steering trolleys, with no sharp change in direction at the switch, thus improving passenger comfort and the stability of the transportation unit.

Clearly, changes may be made to the switch and cable transportation system as described herein without, however, departing from the scope of the accompanying claims.

The invention is claimed as follows:

1. A cable transportation system switch comprising:

a first rail including a straight portion;

a second rail including a straight portion forming an angle of more than 0 degrees and less than 45 degrees with the straight portion of the first rail; and a third straight rail located between the straight portion of the first rail and the straight portion of the second rail, said third straight rail including a first guide member and a second guide member located on opposite sides of a web of the third straight rail to define respective curved paths tangent to the web of the third straight rail, said third straight rail being selectively moveable between:

(i) a first operating position in which a free end of the third straight rail forms a first joint with the first rail and the third straight rail is parallel to the straight portion of the second rail, and (ii) a second operating position in which the free end of the third straight rail forms a second joint with the second rail and the third straight rail is parallel to the straight portion of the first rail.

2. The cable transportation system switch of claim 1, wherein the third straight rail is rotatable about an axis perpendicular to a plane of the first rail, the second rail, and the third straight rail.

3. The cable transportation system switch of claim 2, wherein the axis is equidistant from the first rail and the second rail.

4. The cable transportation system switch of claim 2, which includes:

a fourth straight rail parallel to the straight portion of the first rail; and a fifth straight rail parallel to the straight portion of the second rail;

the fourth straight rail and the fifth straight rail forming a vertex close to the axis.

5. The cable transportation system switch of claim 4, wherein the actuating device includes a linear actuator located between a first end and a second end of the third straight rail.

6. The cable transportation system switch of claim 1, which includes an actuating device connected to the third straight rail to move the third straight rail between the first operating position and the second operating position.

7. The cable transportation system switch of claim 1, wherein:

the first rail has a first contoured portion;

the second rail has a second contoured portion; and the free end of the third straight rail is configured to form the first with the first contoured portion of the first rail, and the free end of the third straight rail is configured to form the second joint with the second contoured portion of the second rail.

8. The cable transportation system switch of claim 7, wherein:

the first rail, the second rail, and the third straight rail each have a top portion and a bottom portion;

the bottom portion of the first rail defines a first rail bottom portion cutout along the first contoured portion;

the bottom portion of the second rail defines a second rail bottom portion cutout along the second contoured portion; and the top portion of the free end of the third straight rail defines a third straight rail top portion cutout such that:

the first rail and the third straight rail overlap in the first operating position, and the second rail and the third straight rail overlap in the second operating position.

9. The cable transportation system switch of claim 7, wherein:

the first rail, the second rail, and the third straight rail each include an upper flange defining a rolling track for a transportation unit;

the upper flange of the first rail defines a first rail upper flange cutout along the first contoured portion;

the upper flange of the second rail defines a second rail upper flange cutout along the second contoured portion; and the upper flange at the free end of the third straight rail is complementary in shape to the cutouts in the first rail and the second rail.

10. The cable transportation system switch of claim 7, wherein:

the first rail and the second rail each include a web; and the web of the first rail, the web of the second rail and the web of the third straight rail define a rolling track for a steering trolley of a transportation unit.

11. A cable transportation system comprising:

at least one transportation unit having wheels, and steering trolleys configured to steer the wheels;

a track along which the at least one transportation unit runs;

two hauling cables configured to be engaged by the at least one transportation unit; and a switch located along the track and including:

a first rail including a straight portion;

a second rail including a straight portion forming an angle of more than 0 degrees and less than 45 degrees with the straight portion of the first rail; and a third straight rail located between the straight portion of the first rail and the straight portion of the second rail, said third straight rail including a first guide member and a second guide member located on opposite sides of a web of the third straight rail to define respective curved paths tangent to the web of the third straight rail, said third straight rail being selectively moveable between:

(i) a first operating position in which a free end of the third straight rail forms a first joint with the first rail and the third straight rail is parallel to the straight portion of the second rail, and (ii) a second operating position in which the free end of the third straight rail forms a second joint with the second rail and the third straight rail is parallel to the straight portion of the first rail.

12. The cable transportation system of claim 11, wherein the third straight rail is rotatable about an axis perpendicular to a plane of the first rail, the second rail, and the third straight rail.

13. The cable transportation system of claim 12, wherein the axis is equidistant from the first rail and the second rail.

14. The cable transportation system of claim 12, which includes:

a fourth straight rail parallel to the straight portion of the first rail; and a fifth straight rail parallel to the straight portion of the second rail;

the fourth straight rail and the fifth straight rail forming a vertex close to the axis.

15. The cable transportation system of claim 14, wherein the actuating device includes a linear actuator located between a first end and a second end of the third straight rail.

16. The cable transportation system of claim 11, which includes an actuating device connected to the third straight rail to move the third straight rail between the first operating position and the second operating position.

17. The cable transportation system of claim 11, wherein:

the first rail has a first contoured portion;

the second rail has a second contoured portion;

the free end of the third straight rail is configured to form the first joint with the first contoured portion of the first rail, and the free end of the third straight rail is configured to form the second joint with the second contoured portion of the second rail.

18. The cable transportation system of claim 17, wherein:

the first rail, the second rail, and the third straight rail each have a top portion and a bottom portion;

the bottom portion of the first rail defines a first rail bottom portion cutout along the first contoured portion;

the bottom portion of the second rail defines a second rail bottom portion cutout along the second contoured portion; and the top portion of the free end of the third rail defines a third straight rail top portion cutout such that:

the first rail and the third straight rail overlap in the first operating position, and the second rail and the third straight rail overlap in the second operating position.

19. The cable transportation system of claim 17, wherein:

the first rail, the second rail, and the third straight rail each include an upper flange defining a rolling track for a transportation unit;

the upper flange of the first rail defines a first rail upper flange cutout along the first contoured portion;

the upper flange of the second rail defines a second rail upper flange cutout along the second contoured portion; and the upper flange at the free end of the third straight rail is complementary in shape to the cutouts in the first rail and the second rail.

20. The cable transportation system of claim 17, wherein:

the first rail and, the second rail, each include a web; and the web of the first rail, the web of the second rail and the web of the third straight rail define a rolling track for a steering trolley of the at least one transportation unit.

* * * * *